United States Patent [19]

Harris et al.

[11] Patent Number: 4,499,630

[45] Date of Patent: Feb. 19, 1985

[54] MANUAL CONTROL KNOB WITH ADJUSTABLE POINTER ASSEMBLY

[75] Inventors: Stephen K. Harris; Wiley W. Miller, both of Mansfield, Ohio

[73] Assignee: The Tappan Company

[21] Appl. No.: 423,646

[22] Filed: Sep. 27, 1982

[51] Int. Cl.[3] ..... G05G 1/10

[52] U.S. Cl. ..... 16/121; 16/DIG. 30; 74/553

[58] Field of Search ..... 16/118, 121, DIG. 30; 74/553, 557; 403/92, 93, 116, 117; 116/307, 309, DIG. 21

[56] References Cited

U.S. PATENT DOCUMENTS

| | | | |
|---|---|---|---|
| 1,477,785 | 12/1923 | Szukalski, Jr. | 16/118 |
| 1,498,985 | 6/1924 | Van Deventer | 16/DIG. 30 X |
| 2,541,892 | 2/1951 | Schulze | 16/121 X |
| 2,651,281 | 9/1953 | Nathan | 116/309 |
| 3,176,541 | 4/1965 | Keeling, Sr. et al. | 74/553 |
| 3,396,604 | 8/1968 | Samuels et al. | 74/553 X |
| 3,561,287 | 2/1971 | Lawrence, Jr. | 16/121 X |
| 3,902,375 | 9/1975 | Herrick et al. | 74/553 X |

*Primary Examiner*—Fred A. Silverberg
*Attorney, Agent, or Firm*—Alfred E. Miller

[57] ABSTRACT

An adjustable knob assembly for operating a gas valve includes a rotatable knob affixable to the shaft of the gas valve and having a hub with an axially extending ridge. An annular pointer is angularly displaceably affixed to the hub and has opposed sets of adjacent grooves selectively alignable to engage the ridge on the hub, to permit angular displacement of the pointer with respect to the shaft.

9 Claims, 6 Drawing Figures

Fig. 3.
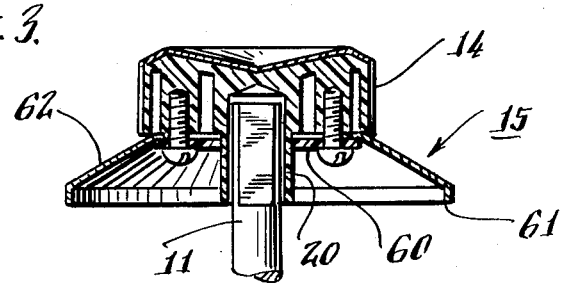
Fig. 1.
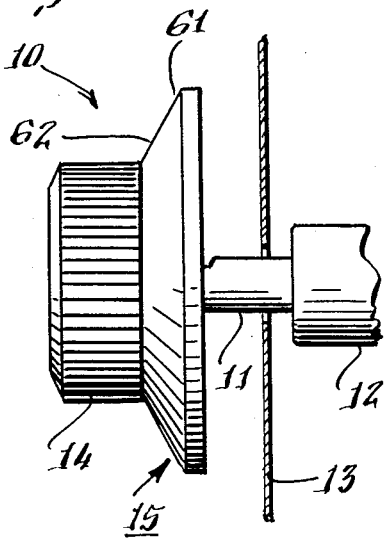
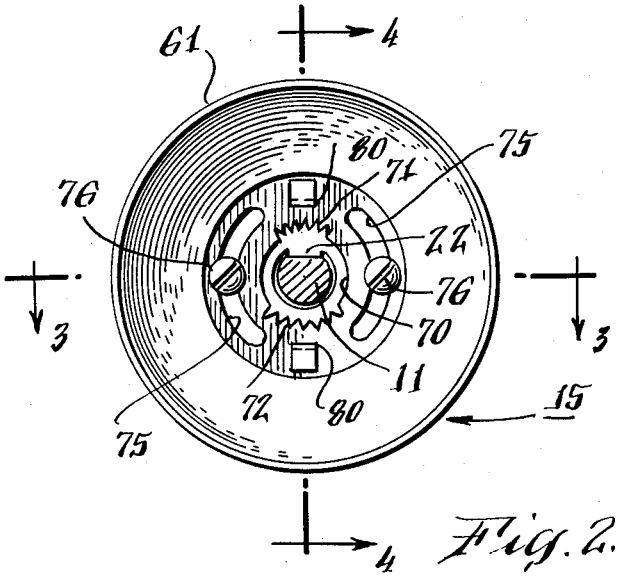
Fig. 2.
Fig. 4.
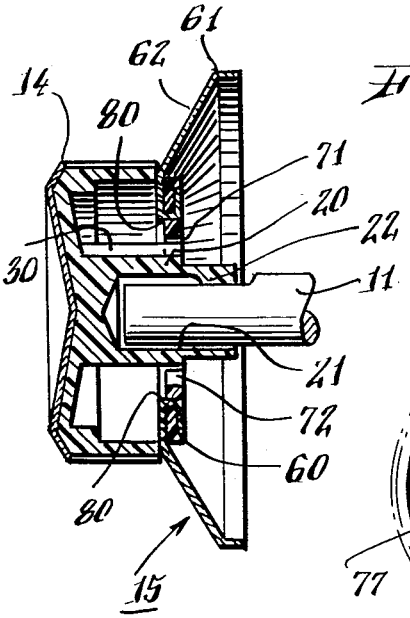
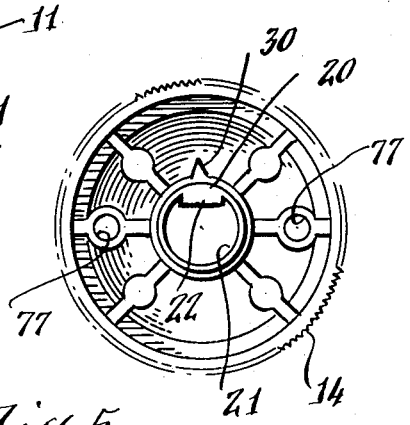
Fig. 5.
Fig. 6.
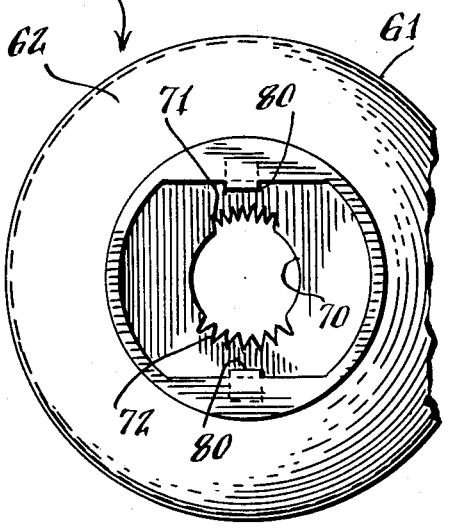

MANUAL CONTROL KNOB WITH ADJUSTABLE POINTER ASSEMBLY

This invention relates to manual control knobs, and is particularly directed to the provision of an adjustable knob assembly for use in combination with valves of gas heating appliances such as ranges and ovens.

In conventional control assemblies for gas ranges and ovens, the knobs for controlling the gas valves are not generally provided with any adjustment facilities that would enable a user to control the position of the knob or pointer with respect to the position of the valve. Adjustments of this type must generally be made by qualified personnel, and, as a result of the expense involved in such adjustment, the average user must be content with inacurrate control positioning.

The present invention is therefore directed to the provision of an improved knob assembly, especially adapted for manual control of the valves of gas heating appliances, wherein the knob assembly may be readily adjusted by a user, so that a limited degree of adjustment of the control is safely attainable, without any necessity for adjustment of the gas valve itself. The invention is further directed to the provision of an improved adjustable assembly of this type, which is readily and economically produced, and which is readily adaptable for use with different types of valve structures.

Briefly stated, in accordance with the invention, a knob assembly is provided comprised of a manually rotatable knob. The knob is adapted to be rigidly affixed to the shaft of the gas valve, the end of the knob being shaped to enable the user to readily and easily rotate the gas valve shaft. The knob preferably has a central hub at its rear side, with an aperture for receiving the shaft. The aperture is conventionally "D" shaped to inhibit relative rotation of the shaft and knob, and is conventionally provided with a spring insert to firmly but releasably hold the control knob on the shaft.

The knob assembly of the invention further includes a pointer assembly affixable to the hub at the rear of the knob and having indicating means extending beyond the periphery of the knob, so as to enable indication of the angular displacement of the shaft, for example, with respect to an index marker on the appliance. The pointer is preferably disc-shaped having suitable markings distributed about its circumference that may be selectively aligned with the index marker on the appliance.

In accordance with the invention, the outer circumference of the hub of the knob is generally a circular cross section, having at least one axially extending ridge at a determined angular position with respect to the shaft. The ridge may hence be oriented in a determined manner with respect to the flat of the D-shaped aperture of the knob. The central aperture of the pointer assembly is provided with a plurality of axially extending circumferentially spaced apart recesses adapted to selectively engage the ridge of the hub. As a consequence, the pointer assembly may be selectively placed at a number of angular positions with respect to the knob, and hence with respect to a given angular position of the shaft.

In a particular advantageous embodiment of the invention, the pointer is comprised of an annular element of plastic or the like having two groups of axially extending recesses in its central aperture, the two groups being diametrically located and having different spacings between the respective recesses. The provision of the two groups of recesses enables the annular element to be located with recesses of either of the groups aligned with the ridge on the hub, so that incremental angular displacements of the pointer with respect to the knob may be set in accordance with the type of gas valve employed. The pointer, in this embodiment of the invention, further includes an outer annular element affixed to the central element, the outer element for example being of stamped metal and having markings thereon. In view of the provision of two sets of recesses in the inner element, means are also provided for selectively assembling the inner and outer elements at positions 180° with respect to each other.

The knob is of course further provided with means for holding the pointer affixed to the knob at the desired position.

In order that the invention will be more clearly understood, it will now be disclosed in greater detail with reference to the accompanying drawings, wherein:

FIG. 1 is a side view of the knob of the invention illustrated assembled on the shaft of the valve of an appliance;

FIG. 2 is a rear view of the knob of FIG. 1;

FIG. 3 is a longitudinal cross section of the knob taken along the lines 3—3 of FIG. 2;

FIG. 4 is a longitudinal cross sectional view of the knob, normal to the section of FIG. 3, and taken along the lines 4—4 of FIG. 2;

FIG. 5 is a rear view of the knob portion of the knob assembly of FIG. 1 and;

FIG. 6 is a front view of the pointer assembly of the knob assembly of FIG. 1.

Referring now to the drawings, and more in particular to FIG. 1, the knob assembly 10 is adapted to be mounted on the shaft 11 of a gas valve 12 or the like, for example of a gas range or oven, the shaft 11 shown extending through a suitable panel 13 or the like of the appliance. The knob assembly includes a knob 14 on the end thereof away from the valve, and a dial assembly or pointer assembly 15 mounted on the rear of the knob. The pointer 15 has a diameter greater than that of the knob, so that, for example, radially extending markings (not shown) thereon may be aligned with a suitable index marking (not shown) on the appliance, for example on the panel 13.

The knob 14 is adapted to be removably affixed to the shaft 11, in a manner to inhibit relative rotation between the shaft and the knob. For this purpose, for example, the end of the shaft may have a D-shaped cross section, with the knob having a rearwardly extending central hub 20 with a D-shaped aperture 21 for receiving the shaft. A conventional spring insert 22 is provided in the aperture 21 to firmly hold the knob on the shaft, while still permitting it to be removed or reassembled thereon without great difficulty.

The knob 14 preferably has a generally circular cross section, as illustrated in FIG. 5, with axially extending fluting to enable easy manipulation by the operator. It is of course apparent that any other configuration for this purpose may be employed. The knob may be conveniently molded of a plastic material, with or without plastic inserts for ornamentation as illustrated.

The hub 20 extends rearwardly of the main body of the knob 14, so that the pointer 15 may be affixed on the hub to the rear of the main portion of the knob 14. The hub 20 preferably has a circular outer section, which may be stepped radially inwardly toward the rear end of the knob, as illustrated. An axially extending ridge 30 is provided on the outer diameter of the hub, in the region thereof immediately rear of the back of the main portion of the knob, this ridge 30 being located at a predetermined angular position with respect to the shaft. For this purpose, for example, the ridge may be radially aligned with the center of the flat of the D-shaped aperture in the hub.

The pointer 15, in the illustrated embodiment of the invention, is comprised of a central annular disc 60, for example, of a plastic material, and an outer annular element 61 affixed thereto. The element 61, which may be a sheet metal stamping, preferably has a slightly backwardly tapered outer edge 62 with suitable, for example radially directed, markings thereon (not shown) for indicating the angular disposition of the knob. The outer edge of the element 61 may terminate in an axially directed portion 63.

The central annular element 60 has a central aperture 70 therein of a diameter substantially equal to that of the diameter of the hub at the rear of the main portion of the knob. First and second groups 71, 72 of axially extending spaced apart grooves or recesses are provided in the aperture 70, at diametrically opposite positions. These grooves or recesses are of a dimension to enable the ridge 30 of the hub to extend into any of them. The spacings of the respective grooves or recesses in the groups 71 and 72 in the circumferential direction is different.

The annular element 60 further has a pair of diametrically opposite slots 75 for receiving screws 76 threadable into holes 77 in the rear of the knob. The arcuate slots 75 are positioned to enable the annular element 60 to be releasably affixed to the rear of the knob, with the ridge 30 of the hub engaging any selected one of the grooves or recesses of the groups 71 or 72. Since the grooves or recesses in the groups 71 and 72 are circumferentially spaced by different distances, it is apparent that the angular displacement of the annular element 60 may be effected in different angular increments, depending upon whether the ridge 30 is aligned with the group 71 or the group 72. This feature of the invention enables the adjustable knob to be employed with gas valves of different type, i.e., having different valve opening characteristics as a function of angular displacement of the respective shaft. Thus, the alignment of the ridge 30 with an adjacent one of the recesses in the annular element 60 can have the same general effect upon the through put of the valve, for different type of valves, by selecting the group of recesses to be aligned with the ridge 30. In accordance with the invention this feature is provided without requiring the provision of differently formed knob assemblies.

Since the pointer assembly may be positioned at diametrically opposite locations with respect to the knob, in accordance with the invention the outer pointer element 15 may be affixed at diametrically opposite positions, so that the pointer will be properly indexed for the selected type of gas valve employed. For this purpose, as more clearly illustrated in FIGS. 4 and 6, the central aperture of the outer annular element 61 has a pair of diametrically opposite radially inwardly directed tabs 80 that may be bent to extend through suitable slots in the annular element 60, to affix the inner and outer elements together selectively at positions that are 180° apart.

While the invention has been disclosed and described with reference to a single embodiment, it will be apparent that variations and modifications may be made therein, and it is therefore intended in the following claims to cover each such variation and modification as falls within the true spirit and scope of the invention.

What is claimed is:

1. In a knob assembly for a rotatable shaft of an appliance, the knob assembly having a manually rotatable knob adapted to be affixed to the shaft, and a pointer means angularly displaceably affixed to the knob, the improvement wherein said knob has a rearwardly extending hub with a generally circular cross section and a central aperture for receiving said shaft, an axially extending ridge having its longitudinal extent along and unitary with the outer circumference of said hub, said pointer means comprising an annular element having an outer diameter greater than that of said knob and a central aperture for receiving said hub, the central aperture of the pointer means having two groups of a plurality of circumferentially spaced axially extending recesses, said recesses each being adapted to selectively engage said ridge to inhibit relative rotation of the knob and pointer means, and means releasably holding said pointer means on said hub with said ridge extending into a selected one of said recesses.

2. The knob assembly of claim 1 wherein said groups of recesses comprises first and second diametrically opposite groups of recesses in the central aperture of said pointer means, the recesses of said first and second groups having different relative circumferential spacings.

3. The knob assembly of claim 2 wherein said means releasably holding said pointer means comprises a pair of diametrically opposite arcuate apertures coaxially located in said pointer means, and a pair of screws threaded in said knob and adapted to extend through separate ones of said arcuate apertures.

4. The knob assembly of claim 3 wherein said screws are positioned on a common diametrical line of said knob.

5. The knob assembly of claim 4 wherein said central aperture of said hub is substantially D-shaped, whereby said knob is angularly fixed with respect to said shaft.

6. The knob assembly of claim 2 wherein said pointer means comprises an inner annular disc-shaped element defining said central aperture of the pointer means and the recesses therein, and an outer element for indicating the angular displacement of said knob assembly, said outer element being selectively affixable to said inner element at positions that are 180° apart.

7. The knob assembly of claim 6 wherein said inner annular element has a pair of diametrically opposite slots extending therethrough, and said outer element has a pair of tabs positioned to axially extend through said slots, whereby said outer element may be mounted on said inner element in either of two positions that are 180° apart.

8. A knob assembly of claim 7 wherein said outer element is mounted between said inner element and knob, said outer element being of metal, with said tabs extending through said slots and being bent to hold said outer element on to said inner element.

9. The knob assembly of claim 8 wherein said inner element further comprises a pair of diametrically opposite arcuate slots, and said means initially holding said pointer means on said hub comprises screws extending through said arcuate slots into said hub, whereby the angular displacement between said hub and inner element may be varied.

* * * * *